United States Patent [19]

Meredith

[11] Patent Number: 4,795,938

[45] Date of Patent: Jan. 3, 1989

[54] INJECTION MOLDED AUTOMOTIVE SPARK PLUG

[75] Inventor: Jerry R. Meredith, Knoxville, Tenn.

[73] Assignee: Sur-Fire, Inc., Clawson, Mich.

[21] Appl. No.: 940,376

[22] Filed: Dec. 11, 1986

[51] Int. Cl.[4] ..... H01T 13/20; H01T 13/38

[52] U.S. Cl. ..... 313/143; 313/137; 313/141; 123/169 E

[58] Field of Search ..... 313/118, 137, 141, 143, 313/140, 130, 144, 145; 123/169 R, EL, E, P

[56] References Cited

U.S. PATENT DOCUMENTS 1,941,279 12/1933 Sharpnack ..... 313/143

2,222,433 11/1940 Hastings, Jr. ..... 123/169 P 2,478,259 8/1949 Feichter ..... 313/143

2,498,822 2/1950 Palmer ..... 313/140

*Primary Examiner*—David K. Moore

*Assistant Examiner*—Michael Horabik

*Attorney, Agent, or Firm*—John E. Benoit

[57] ABSTRACT

Automotive spark plug having an injection molded body which includes the central electrode and connecting cap and the grounded electrode. In one embodiment, the grounded electrode is secured to a threaded metal cap which is mounted on a band integral with the molded body, and which has support legs extending into the molded body. In a second embodiment, the molded body is appropriately threaded and the grounded electrode extends into the interior radius of the threads so as to provide a proper ground.

2 Claims, 1 Drawing Sheet

INJECTION MOLDED AUTOMOTIVE SPARK PLUG

The present invention relates generally to automotive spark plugs, particularly for use with internal combustion engines, in a single manufacturing step using a special high-temperature copolymer plastic.

BACKGROUND OF THE INVENTION

Conventional spark plugs are formed with a separate hexagonal nut, a metal body which surrounds and supports the central electrode, and a ceramic insulator which surrounds the central electrode rod and electrically insulates the rod from the metal of the hexagonal nut and threads. The ground electrode is normally welded to a conventional outer metal shell which is exteriorally threaded.

While this type of spark plug works well, the cost is substantial due to the component parts used and the manufacture and construction thereof.

The present invention reduces the costs of the material needed and simplifies the manufacture of the plug by reducing it to a single step injection molding process, as subsequently explained.

BRIEF SUMMARY OF THE INVENTION

The present invention provides an automotive spark plug having an injection molded body which includes a central electrode, together with a connecting cap, and a grounded electrode. In one embodiment, the grounded electrode is secured to a threaded metal cap which is mounted on a band extending from the lower end of the molded body. The cap has support legs which extend into the molded body. In a second embodiment the molded body is appropriately threaded and the ground electrode extends into the internal radius of the threads so as to be exposed to the outer surface, thereby providing proper ground contact when the plug is in place.

DETAILED DESCRIPTION OF THE PREFERRED EMBODIMENTS

Figure 1:
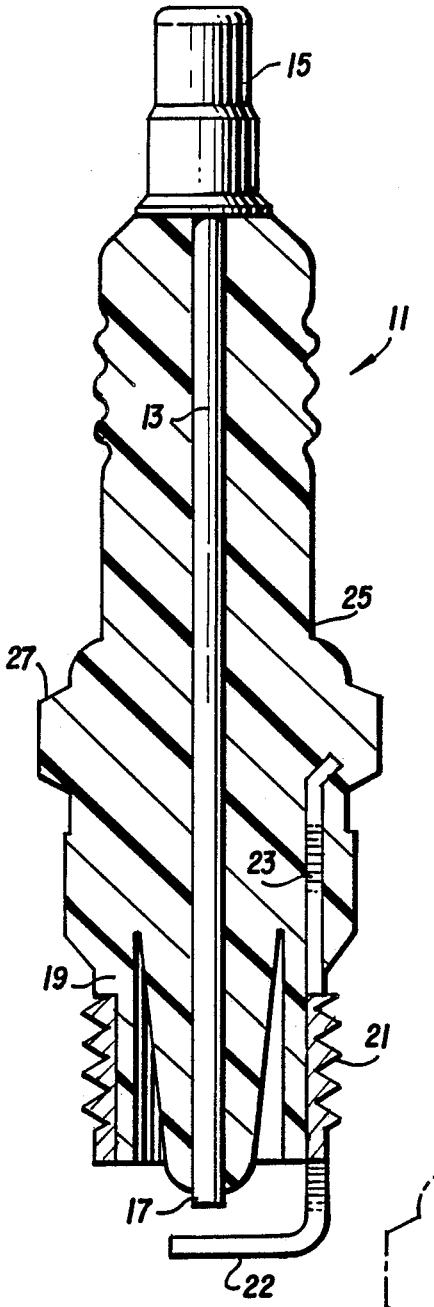
FIG. 1 is a partial sectional view of one embodiment of the spark plug of the present invention.

Referring now to FIG. 1, there is shown a cross-sectional view of one embodiment of the present invention. Spark plug 11 includes a single elongated central electrode rod 13 which extends the substantial length of the plug body 25 and terminates at the upper end in connector cap 15 and at the lower end in the sparking tip 17. Also at the lower end of the plug and integral therewith is cylindrical mounting band 19. This band is designed to hold the metallic structure shown in FIG. 2.

Figure 2:
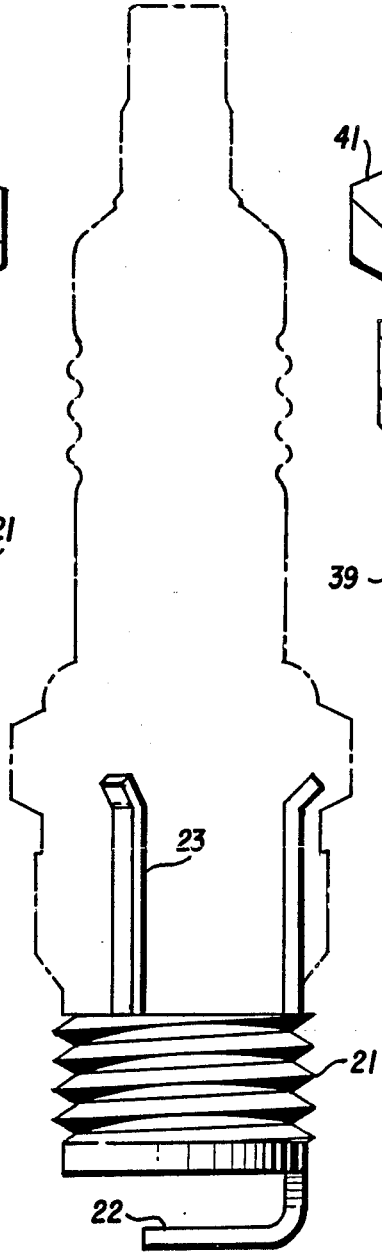
FIG. 2 is a side elevation view of the threaded metal cap and ground electrode used in FIG. 1.

The metallic structure includes a threaded cylinder 21 having a ground electrode 22 secured thereto by means such as welding or the like, and upper support rods 23 also secured to the interior of the threaded cylinder 21. In the manufacture of the plug shown in FIG. 1, the metal structure of FIG. 2 is placed in the mold, as is the central electrode 13 and cap 15. When these structures are in place, the injection molding process begins and the plug is completed and removed from the mold in the form shown in FIG. 1.

The support legs 23 are angled at the upper end thereof so as to prevent any possible rotation of the threaded area when the plug is being screwed into position.

The plug body 25 is also molded with a hexagonal nut central section 27, which allows the spark plug to be inserted into an engine by a conventional plug wrench.

The molded body 25 of the plug comprises a unitary injection molded insulator material formed from an acrylonitrile butadiene styrene (ABS) copolymer which is molded about the central electrode and the support structure. In the preferred embodiment, the ABS copolymer is an injection molding, blow molding, or extruding grade non-conductive, heat resistant copolymer having high dimensional stability at temperatures exceeding 500° F. ABS alloys may be used, which include polycarbonate alloy. This alloy possesses improved heat resistance.

Figure 3:
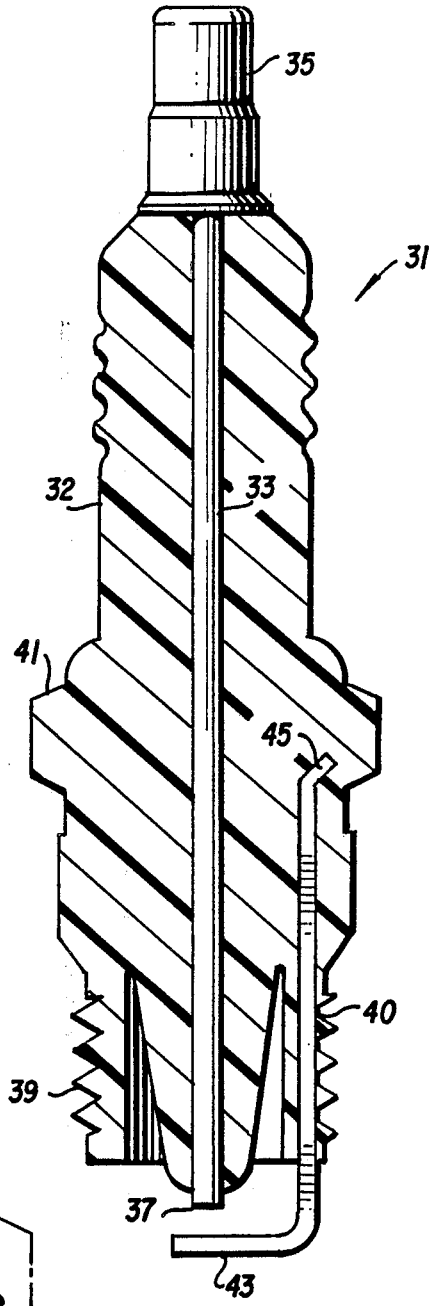
FIG. 3 is a partial sectional view of a second embodiment of the present invention.

FIG. 3 shows a further embodiment of the present invention wherein spark plug 31 comprises molded body 32 with the central electrode 33, cap 35, mat 41, and tip 37 being substantially the same as that described relative to FIG. 1. Body 32 is also molded from an ABS plastic material. In this embodiment, however, the lower threaded part 39 of the body 32 is also molded from a plastic material. The ground electrode 43 extends upwardly and terminates in support structure 45. In this construction, the ground electrode 43 is placed in the mold such that it mates with the interior diameter 40 of the threaded section 39. This exposes ground electrode 43 to the engine block (not shown) when the plug is screwed into the block so that a proper ground is provided.

It will now be seen that the present invention forms the entire body of a spark plug from a single piece of injected molded ABS plastic. The spark plug may be manufactured using a metal threaded member in conjunction with the ground electrode or a ground electrode may be molded directly into the body wherein the body is threaded at the lower section thereof.

Obviously, the present invention provides a spark plug which is highly reliable and yet has an extremely low cost of manufacture as compared to spark plugs in present use today.

The above description and drawings are illustrative, only, since modifications could be made without departing from the invention, the scope of which is to be limited only by the following claims.

I claim:

1. A spark plug comprising a molded non-conductive acrylonitrile butodiene styrene body, said body comprising
an upper section;
a lower section;
a central section having a nut configuration; and
an exterior threaded portion on said lower section;

said acrylonitrile butodiene styrene being an injection-molding, blow-molding, or extruding grade non-conductive heat resistant copolymer having high dimensional stability at temperatures exceeding 500° Fahrenheit;

a central electrode extending substantially the length of said body and terminating in a sparking tip extending outwardly from said lower section;

a connector cap secured to said electrode and extending outwardly of said upper body;

a ground electrode extending from within said lower body and terminating a predetermined fixed distance from the terminal end of said central electrode; and means for exposing said ground electrode to the exterior of said lower section.

2. The spark plug of claim 1 further comprising a polycarbonate alloyed with said acrylonitrile butodiene styrene.

* * * * *